US012522976B2

(12) United States Patent
Zheng et al.

(10) Patent No.: US 12,522,976 B2
(45) Date of Patent: Jan. 13, 2026

(54) CLOTHING CARE MACHINE

(71) Applicant: Tsann Kuen (Zhangzhou) Enterprise Co., Ltd., Fujian (CN)

(72) Inventors: Zhenxing Zheng, Fujian (CN); Ronghuang Chen, Fujian (CN); Ruifeng Cai, Fujian (CN); Xiaodong Xu, Fujian (CN)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 675 days.

(21) Appl. No.: 17/840,976

(22) Filed: Jun. 15, 2022

(65) Prior Publication Data

US 2023/0046720 A1 Feb. 16, 2023

(30) Foreign Application Priority Data

Aug. 13, 2021 (CN) ..... 202110932429.4

(51) Int. Cl.
*D06F 87/00* (2006.01)
*D06F 58/14* (2006.01)

(52) U.S. Cl.
CPC ..... *D06F 87/00* (2013.01); *D06F 58/14* (2013.01)

(58) Field of Classification Search
CPC ..... F16B 7/14; F16B 7/1454; A45C 13/262; A45C 2013/267
See application file for complete search history.

(56) References Cited

U.S. PATENT DOCUMENTS 3,409,996 A * 11/1968 Francisco ..... F24H 3/0417 34/91
5,042,118 A * 8/1991 Rubik ..... F16B 2/12 24/523
5,528,912 A * 6/1996 Weber ..... D06F 58/14 68/222
9,980,548 B1 * 5/2018 Lai ..... A45C 13/26
2002/0157190 A1 * 10/2002 Imai ..... D06F 1/04 68/133
2003/0042092 A1 * 3/2003 Wang ..... B25B 9/00 16/113.1
2006/0213029 A1 * 9/2006 Lu ..... A45C 13/262 16/113.1
2008/0078053 A1 * 4/2008 Lu ..... A45C 13/262 16/113.1
2008/0256989 A1 * 10/2008 Jeong ..... D06F 73/02 392/441

(Continued)

FOREIGN PATENT DOCUMENTS

KR 20200056003 A * 5/2020
WO WO-2022194186 A1 * 9/2022

*Primary Examiner* — Omair Chaudhri
(74) *Attorney, Agent, or Firm* — Cooper Legal Group, LLC

(57) ABSTRACT

The present disclosure provides a clothing care machine, including a machine base, a support column and an upper part. A bottom of the support column is connected to the machine base, and the upper part is connected to a top of the support column. The machine base is provided with at least one of a steam outlet and a hot air outlet. When in use, the clothes are hung on the upper part, and the automatic care of the clothes is realized through the steam output by the steam outlet of the machine base or the hot air output by the hot air outlet. During the process, the user does not need to operate the whole process. Time and effort can be saved.

10 Claims, 13 Drawing Sheets

(56) References Cited

U.S. PATENT DOCUMENTS

| | | | | |
|---|---|---|---|---|
| 2009/0235555 | A1* | 9/2009 | Jie Bo | D06F 58/10 34/82 |
| 2012/0096901 | A1* | 4/2012 | Zattin | D06F 39/02 68/13 R |
| 2013/0334939 | A1* | 12/2013 | Lee | F26B 21/086 312/228 |
| 2014/0090681 | A1* | 4/2014 | Lovley | E04H 15/50 135/140 |
| 2014/0137370 | A1* | 5/2014 | Lo | A45C 13/262 16/113.1 |
| 2014/0158851 | A1* | 6/2014 | Mummaw | D06F 55/02 248/342 |
| 2014/0241789 | A1* | 8/2014 | Chiu | F16B 7/1454 403/109.1 |
| 2015/0204007 | A1* | 7/2015 | Lim | D06F 87/00 68/5 E |
| 2017/0233934 | A1* | 8/2017 | Lee | D06F 39/022 68/200 |
| 2019/0014876 | A1* | 1/2019 | Hamzaee | A45C 13/28 |
| 2022/0049415 | A1* | 2/2022 | Leung | D06F 73/02 |
| 2022/0213639 | A1* | 7/2022 | Park | D06F 58/203 |
| 2024/0247433 | A1* | 7/2024 | Djeroro | D06F 58/203 |

* cited by examiner

CLOTHING CARE MACHINE

RELATED APPLICATIONS

The present disclosure claims priority to Chinese Patent Application No. 202110932429.4, filed on Aug. 13, 2021, which is incorporated herein by reference.

TECHNICAL FIELD

The present disclosure relates to the field of daily life, and in particular, to a clothing care machine.

BACKGROUND

In daily life, when clothes need to be worn or stored, they will be treated with tools in advance, such as ironing by an iron. However, some clothes are not suitable for ironing with an iron, or are inconvenient to be ironed with an iron. Therefore, a clothing care machine different from an iron needs to be designed.

SUMMARY

In view of this, the present disclosure provides a clothing care machine in order to solve the above problems.

For achieving the above object, the technical scheme provided by the present disclosure is as follows:

A clothing care machine, comprising a machine base, a support column and an upper part; a bottom of the support column being connected to the machine base, the upper part being connected to a top of the support column; the machine base being provided with at least one of a steam outlet and a hot air outlet.

In an embodiment, the support column comprises an upper sleeve and a lower sleeve that are telescopically sleeved; a lower end of the lower sleeve is connected to the machine base, and an upper end of the upper sleeve is connected to the upper part; a fixing assembly for fixing relative positions of the upper sleeve and the lower sleeve is provided between the upper sleeve and the lower sleeve.

In an embodiment, the fixing assembly comprises a pin fixing unit comprising a fixing block, an elastic pin and a connecting rod; the fixing block is fixed in a lower opening of the upper sleeve, the elastic pin is provided on the fixing block, the lower sleeve is provided with a pin hole corresponding to the elastic pin; under an action of no external force, a pin of the elastic pin protrudes and is inserted into a corresponding pin hole, such that the relative positions of the upper sleeve and the lower sleeve are fixed; the connecting rod is provided in the upper sleeve, a lower end of the connecting rod forms an oblique guide fit with the elastic pin, and an upper end of the connecting rod extends to a top seat, the elastic pin is driven to retract by the upper end of the connecting rod by driving the connecting rod to press down.

In an embodiment, the lower end of the connecting rod is connected with a fitting piece provided with a guide hole; the fixing block is provided with a guide post penetrating into the guide hole, and the fixing block forms an oblique guide fit with the elastic pin through the fitting piece.

In an embodiment, the elastic pin comprises a spring and a pin body, the fixing block is provided with a blind hole, the spring and the pin body are inserted in the blind hole; when the spring exerts an outward elastic force on the pin body, an outer end of the pin body is protruded with the pin mated with the pin hole.

In an embodiment, the upper part is provided with a button, the upper end of the connecting rod abuts the button, and the connecting rod is pressed down by pressing the button.

In an embodiment, the fixing assembly further comprises an elastic adjusting unit comprising a movable abutting block and a cam; the lower sleeve is provided with a receiving opening, the movable abutting block is provided in the receiving opening; the cam is provided with a hinge and located outside the movable abutting block, such that the movable abutting block is located between the cam and the upper sleeve.

In an embodiment, the upper part is provided with a support frame provided with a support rod, and the support rod is provided with a clamping piece.

In an embodiment, two side surfaces of the support rod are concave surfaces; the clamping piece comprises a clamping body and a hanging lug extending from the clamping body, the hanging lug and the clamping body are enclosed to form a through hole, the support rod penetrates into the through hole to have a connection between the support rod and the clamping piece; one side wall of the hanging lug is inwardly recessed and mated with one side concave surface of the support rod.

In an embodiment, two ends of the support rod are respectively connected with end covers, and are detachably assembled on a top seat through the end covers; and the support rod is detachably connected to at least one of the end covers.

In an embodiment, the machine base is provided with a water tank, a heating and vaporizing boiler, a condensed water collector and a switch valve; a water outlet of the water tank is connected to a water inlet of the heating and vaporizing boiler, an outlet of the heating and vaporizing boiler is connected to the steam outlet; the condensed water collector is disposed on the machine base for collecting condensed water, and a water outlet of the condensed water collector is in communication with a water inlet of the water tank through a recovery channel, the switch valve is provided in the recovery channel; the water tank is detachably provided on the machine base, and the switch valve is triggered to open when the water tank is assembled.

In an embodiment, an upper end of the water tank has an inclined abutting surface, an outside of the machine base is recessed with a water tank receiving cavity, and a trigger end of the switch valve extends into the water tank receiving cavity through a top of the water tank receiving cavity; when the water tank is assembled into the water tank receiving cavity, the inclined abutting surface abuts the trigger end of the switch valve and the switch valve is triggered to be activated.

In an embodiment, the water outlet of the water tank is a normally closed water outlet, and the water tank receiving cavity is provided with a butt joint at a bottom of the water tank receiving cavity; when the water tank is assembled into the water tank receiving cavity, the butt joint cooperates with the water outlet of the water tank to open the water outlet of the water tank.

In an embodiment, a water pump is provided between the water tank and the heating and vaporizing boiler; water in the water tank is pumped into the heating and vaporizing boiler through the water pump.

The technical scheme provided by the present disclosure has the following beneficial effects.

With the clothing care machine, when in use, the clothes are hung on the upper part, and the automatic care of the clothes is realized through the steam output by the steam outlet of the machine base and/or the hot air output by the hot air outlet. During the process, the user does not need to operate the whole process, such that time and effort can be saved.

DESCRIPTION OF EMBODIMENTS

Figure 1:
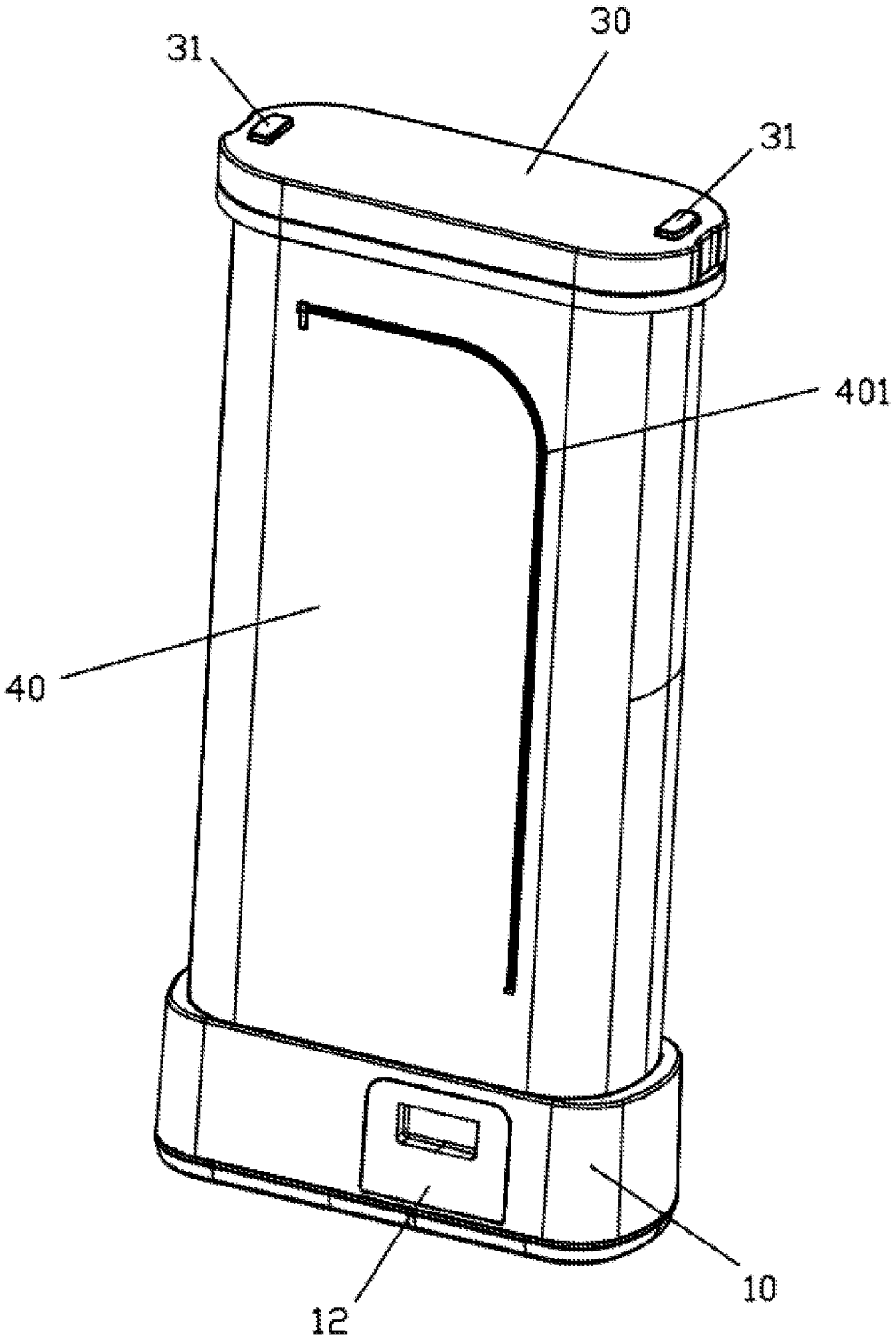
FIG. 1 shows a first perspective view of the clothing care machine in an embodiment.

To further illustrate the various embodiments, the present disclosure is provided with the accompanying drawings. These drawings are a part of the present disclosure, which are mainly used to illustrate the embodiments, and can be used in conjunction with the relevant description of the specification to explain the operation principles of the embodiments. With reference to this content, one of ordinary skill in the art will understand other possible embodiments and advantages of the present disclosure. Components in the figures are not drawn to scale, and similar component symbols are often used to represent similar components.

The present disclosure will now be further described with reference to the accompanying drawings and specific embodiments.

Embodiment 1

Referring to FIG. 1 to FIG. 4, the present embodiment provides a clothing care machine, including a machine base 10, a support column 20, a cloth cover 40 and an upper part. The bottom of the support column 20 may be connected to the machine base 10. Specifically, the upper part may be a substantially rectangular top seat 30 connected to the top of the support column 20, and the cloth cover 40 may be provided between the machine base 10 and the top seat 30 to form an enclosed cavity. The machine base 10 may be provided with a steam outlet 11 and a hot air outlet 19 in communication with the enclosed cavity. When in use, the clothes are put into the enclosed cavity, and the automatic care of the clothes is realized through the cooperation of the steam output by the steam outlet 11 and the hot air output by the hot air outlet 19 of the machine base 10. Specifically, the combination of the steam output from the steam outlet 11 and the hot air output from the hot air outlet 19 may be independent outputs or alternate outputs (e.g., steam output first, then hot air output, etc.). During the process, the user does not need to operate the whole process, but only needs to put the clothes in and out, such that time and effort can be saved.

Figure 3:
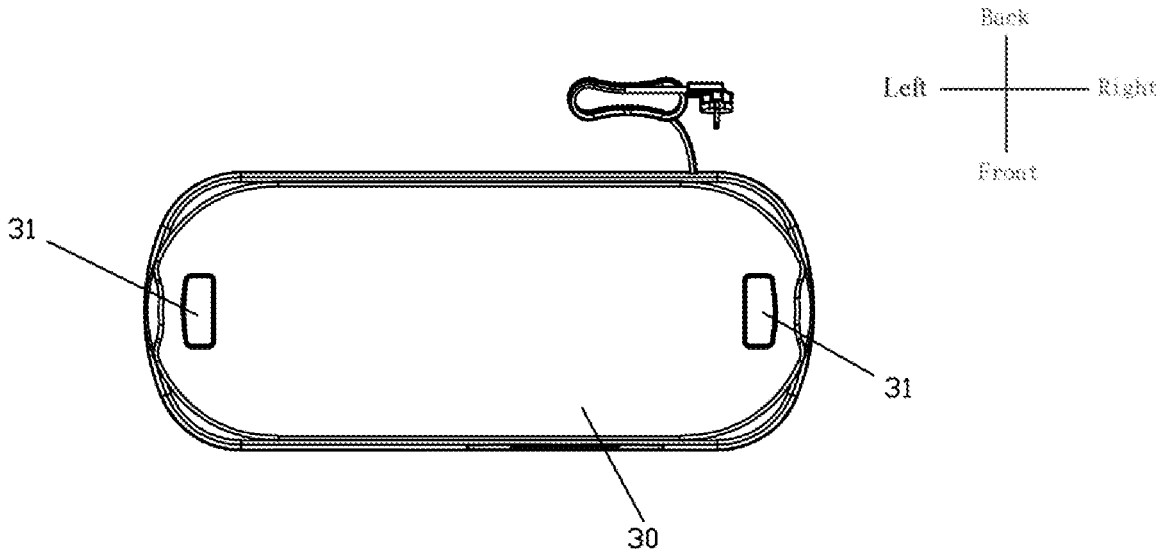
FIG. 3 shows a top view of the clothing care machine in an embodiment.
Figure 4:
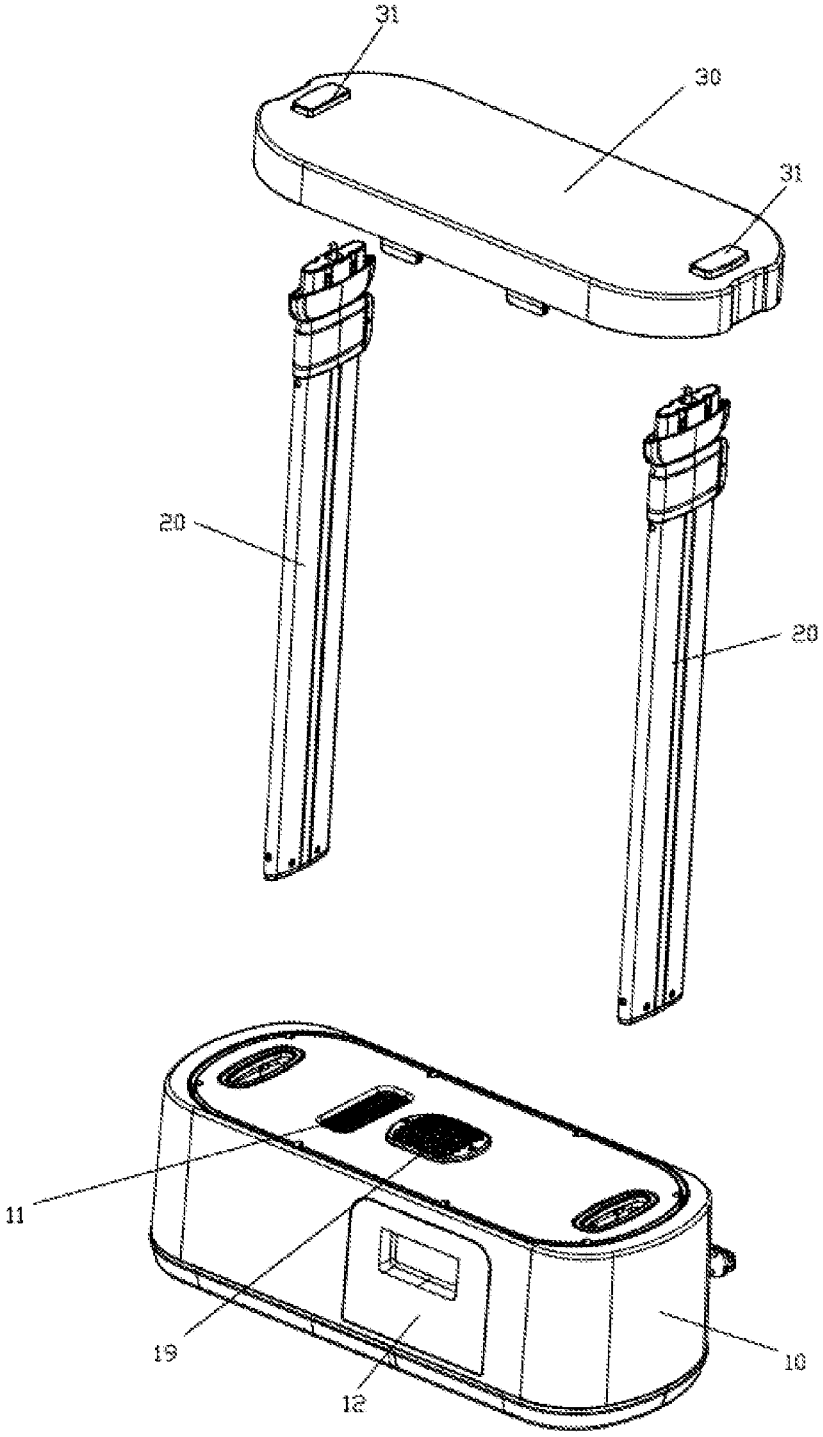
FIG. 4 shows an exploded view of a partial structure of the clothing care machine in an embodiment, where the cloth cover is hidden.
Figure 5:
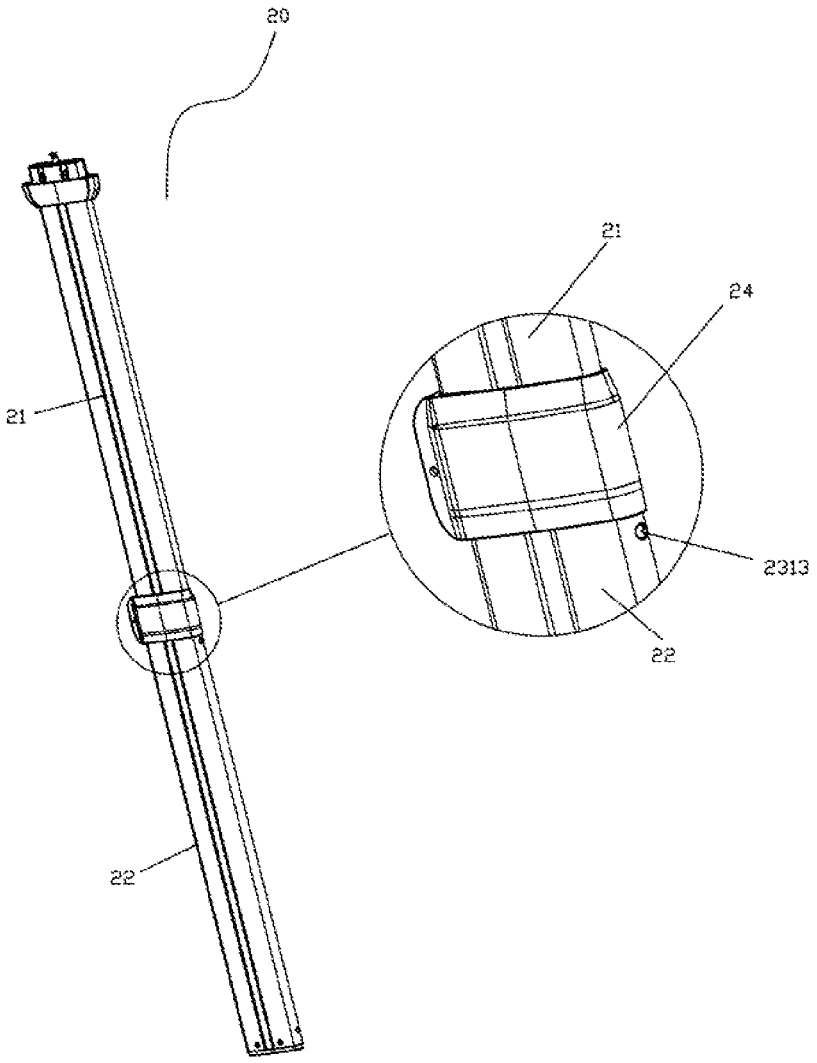
FIG. 5 is a perspective view of a support column in an embodiment in the unfolded state.
Figure 6:
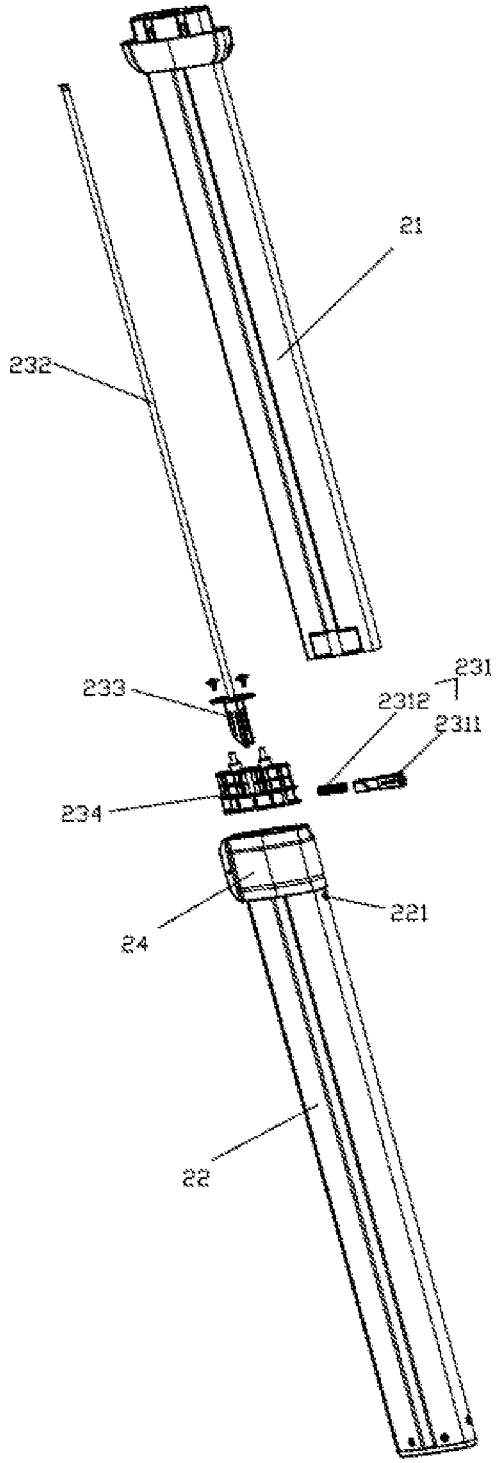
FIG. 6 is an exploded view of a partial structure of the support column in an embodiment.
Figure 7:
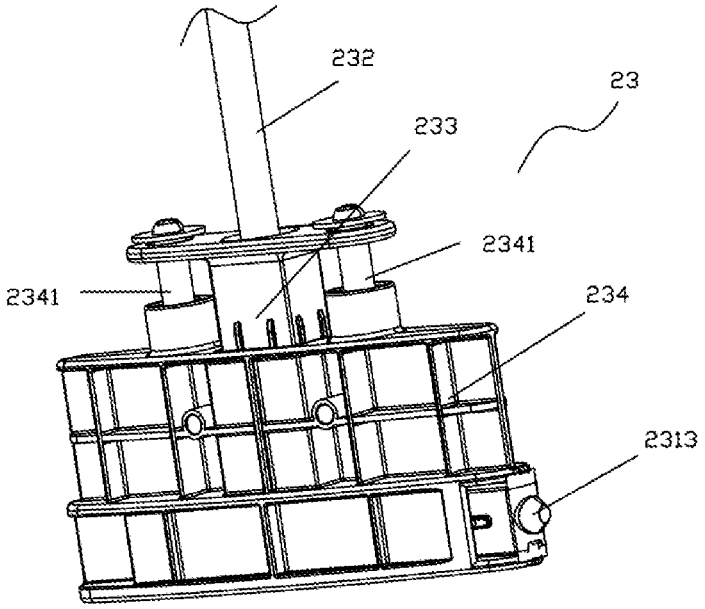
FIG. 7 is a perspective view of a pin fixing unit in an embodiment.
Figure 8:
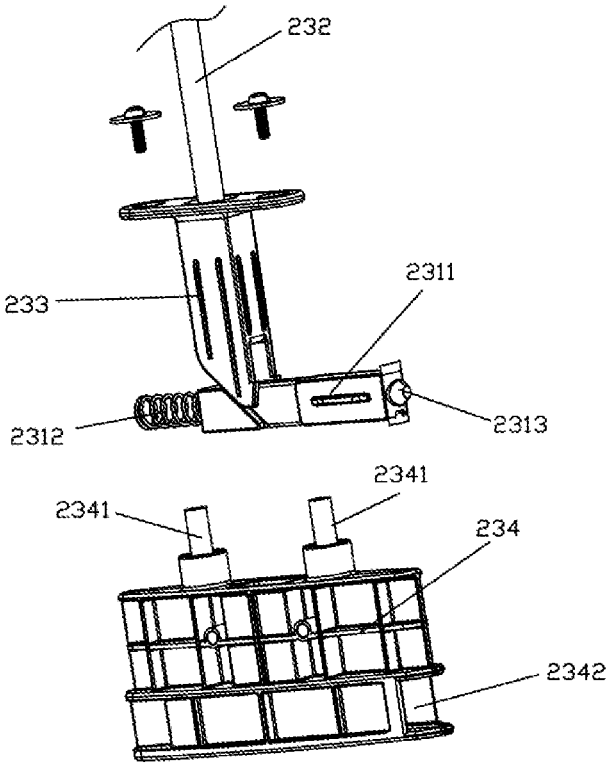
FIG. 8 is an exploded view of the structure shown in FIG. 7.

Specifically, as shown in FIG. 3, the clothing care machine provided in the present embodiment is a rectangle from a top view. The long side direction is defined as a left-right direction, and the short side direction is defined as a front-rear direction. Of course, in other embodiments, the shape of the clothing care machine is not limited to this.

Specifically, the cloth cover 40 may be provided with a zipper 401, and the cloth cover 40 is opened and closed through the zipper 401 for taking and placing clothes into the enclosed cavity.

Further, referring to FIGS. 5 to 10, in the present embodiment, the support column 20 may be a retractable structure. In this way, through the retracting of the support column 20, the clothing care machine can be stored, and the volume after storage is small and does not occupy space. Of course, in other embodiments, the support column 20 can also be a fixed structure without retracting.

Specifically, the retractable structure of the support column 20 may be as follows: the support column 20 includes an upper sleeve 21 and a lower sleeve 22 that are telescopically sleeved, the lower end of the lower sleeve 22 is connected to the machine base 10, and the upper end of the upper sleeve 21 is connected to the top seat 30; a fixing assembly for fixing the relative positions of the upper sleeve 21 and the lower sleeve 22 is provided between the upper sleeve 21 and the lower sleeve 22. During use, the upper sleeve 21 and the lower sleeve 22 are fixed by the fixing assembly to obtain a stable support. When the support column 20 needs to be stored, the support column 20 can be retracted by releasing the fixing of the fixing assembly. At the same time, the use of the sleeve structure of the sleeve can reduce the weight very well. Of course, in other embodiments, the retractable structure of the support column 20 is not limited to this.

The fixing assembly includes a pin fixing unit 23 and a tension adjusting unit, wherein the pin fixing unit 23 may be fixed on one side, and the tension adjusting unit may be fixed on the other side.

Specifically, the pin fixing unit 23 may include: a fixing block 234, an elastic pin 231 and a connecting rod 232. The fixing block 234 may be fixed in the lower opening of the upper sleeve 21, and the elastic pin 231 may be provided on the fixing block 234. The lower sleeve 22 may be provided with a pin hole 221 corresponding to the elastic pin 231. Under the action of no external force, the pin 2313 of the elastic pin 231 protrudes and is inserted into the corresponding pin hole 221 to make the relative positions of the upper sleeve 21 and the lower sleeve 22 fixed, such that the support column 20 can be fixedly supported. The connecting rod 232 may be provided in the upper sleeve 21, and the lower end of the connecting rod 232 forms an oblique guide fit with the elastic pin 231. The upper end of the connecting rod 232 extends to the top seat 30. The connecting rod 232 can be driven to be pressed down to drive the elastic pin 231 to retract. That is, when it is necessary to release the fixation of the pin fixing unit 23, the connecting rod 232 is pressed down, and the downward movement of the connecting rod 232 drives the elastic pin 231 to retract through the inclined guide fit structure, such that the pin 2313 of the elastic pin 231 is separated from the pin hole 221, such that the fixing of the pin fixing unit 23 is released.

The lower end of the connecting rod 232 may be connected with a fitting piece 233 and forms an oblique guide fit with the elastic pin 231 through the fitting piece 233, which is convenient for connecting and fitting. The fitting piece 233 may be provided with a guide hole (not shown), and the fixing block 234 may be provided with a guide post 2341. The guide post 2341 penetrates into the guide hole to realize the guide fit, such that the fit is more precise and smoother and not easy to shift or clamp.

The elastic pin 231 may include a spring 2312 and a pin body 2311, and a blind hole 2342 may be formed on the fixing block 234. The spring 2312 and the pin body 2311 may be inserted into the blind hole 2342, and the spring 2312 applies an outward elastic force to the pin body 2311. The outer end of the pin body 2311 protrudes with the pin 2313 mated with the pin hole 221. The structure is simple and easy to implement. More specifically, the fitting piece 233 forms an oblique guide fit with the pin body 2311.

The top seat 30 may be provided with a button 31, and the upper end of the connecting rod 232 abuts the button 31. By pressing the button 31, the connecting rod 232 is driven to be pressed down, which is convenient for operation. More specifically, the button 31 may be a rocker button, and one end of the button 31 is provided with a hinge. The upper end of the connecting rod 232 may be in contact with the middle position of the button 31, and the other end of the button 31 may be lifted up as a pressing end. By means of rocker buttons, the operation is more convenient and labor-saving, and the structure is simple and easy to implement.

Figure 9:
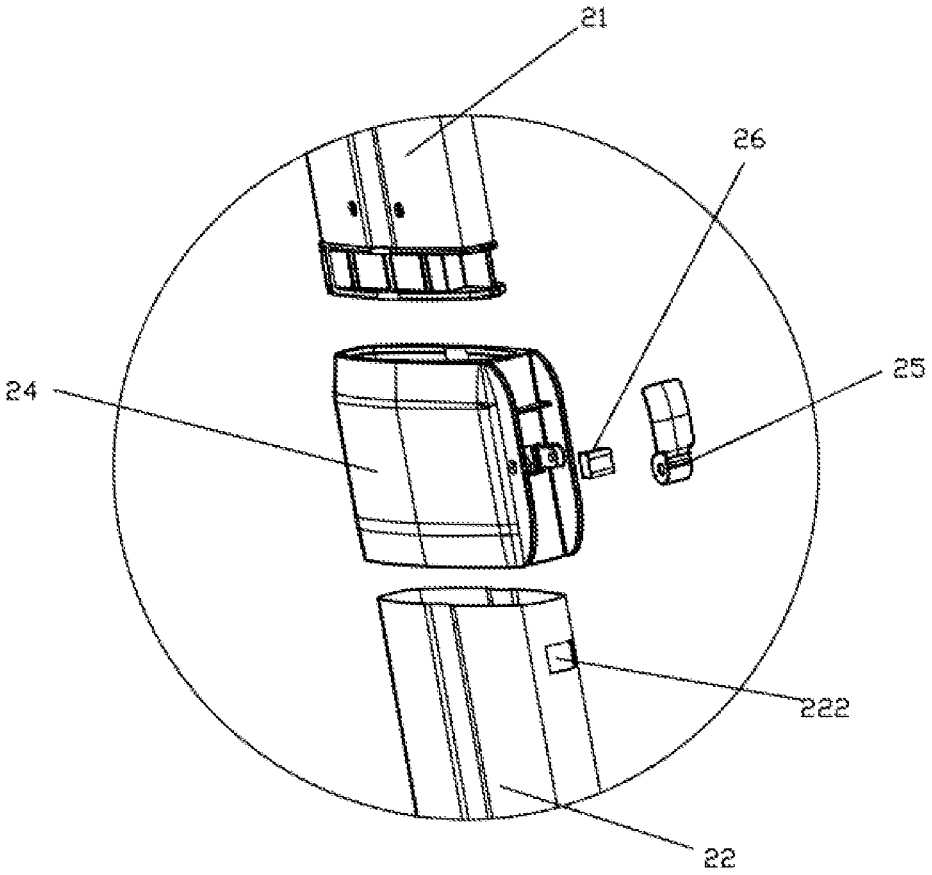
FIG. 9 is an exploded view of the structure of an elastic adjusting unit in an embodiment.
Figure 10:
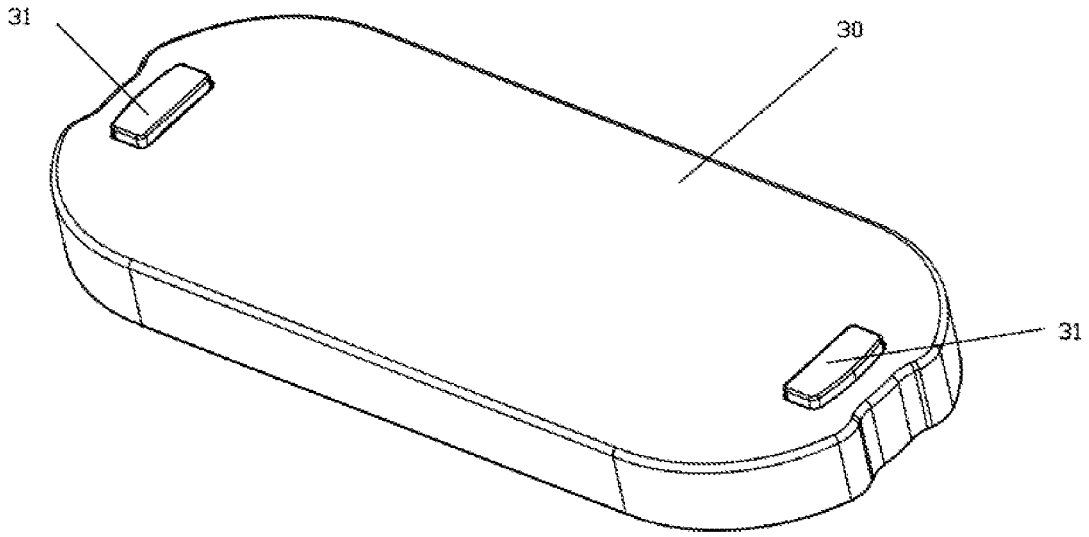
FIG. 10 shows a perspective view of a top seat in an embodiment.
Figure 11:
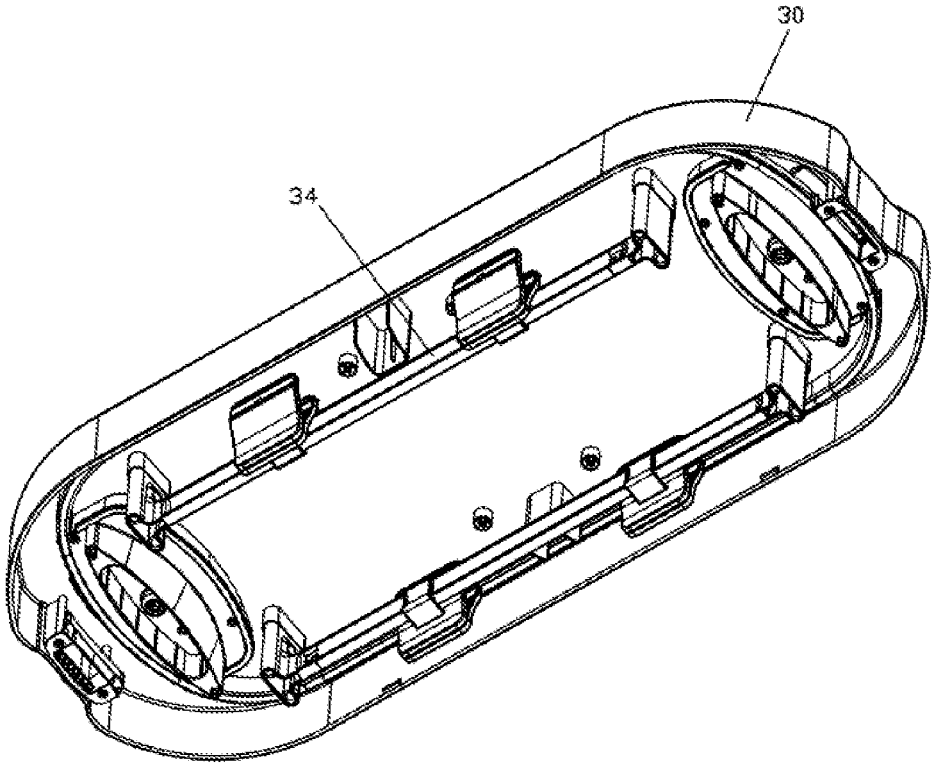
FIG. 11 shows a perspective view of an interior of the top seat in an embodiment.
Figure 12:
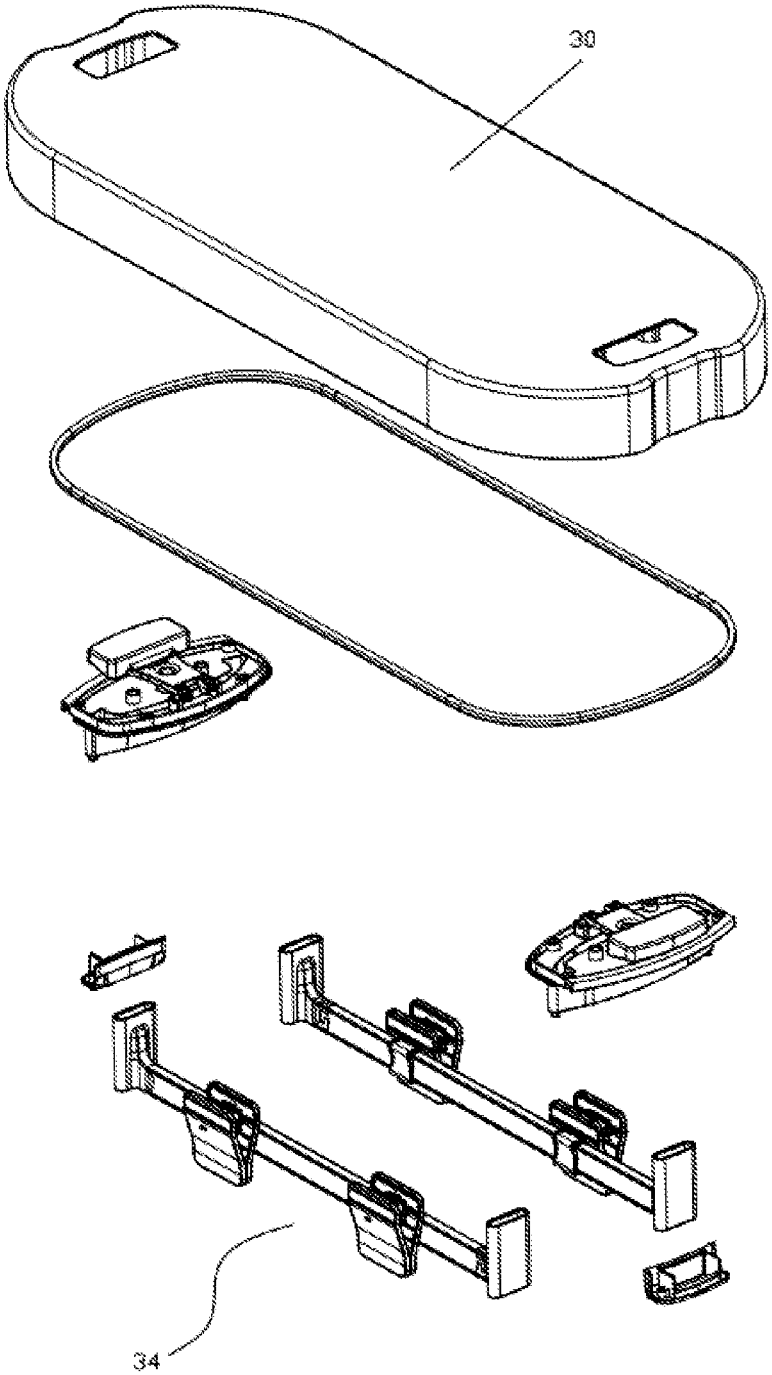
FIG. 12 is an exploded view of the mating structure on the top seat in an embodiment.
Figure 13:
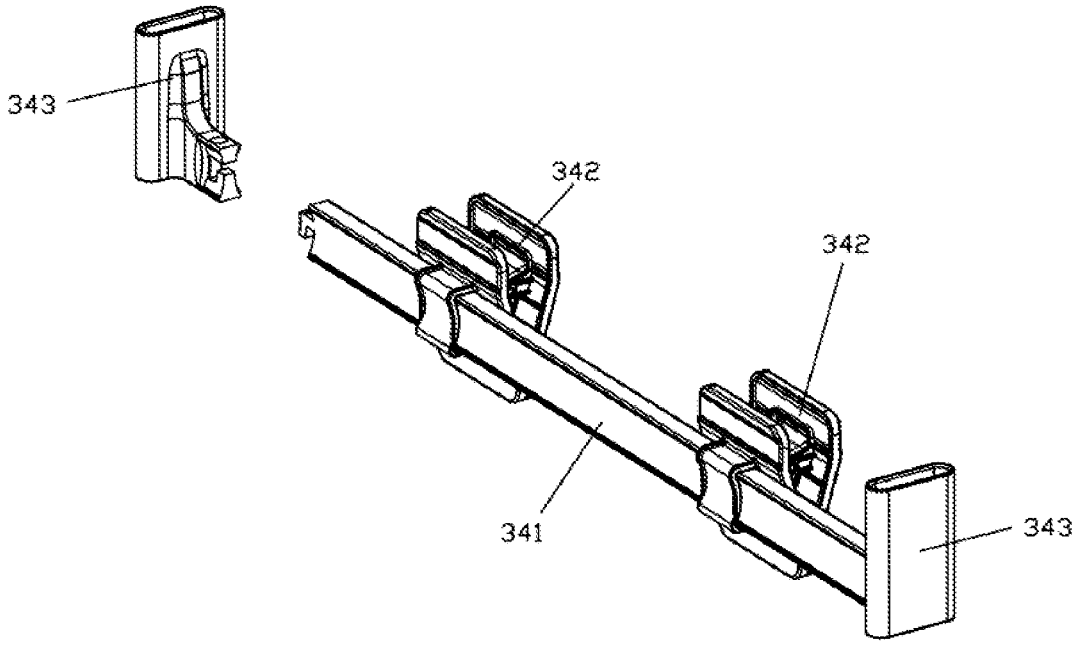
FIG. 13 is a perspective view of a partial structure of a support frame in an embodiment.
Figure 14:
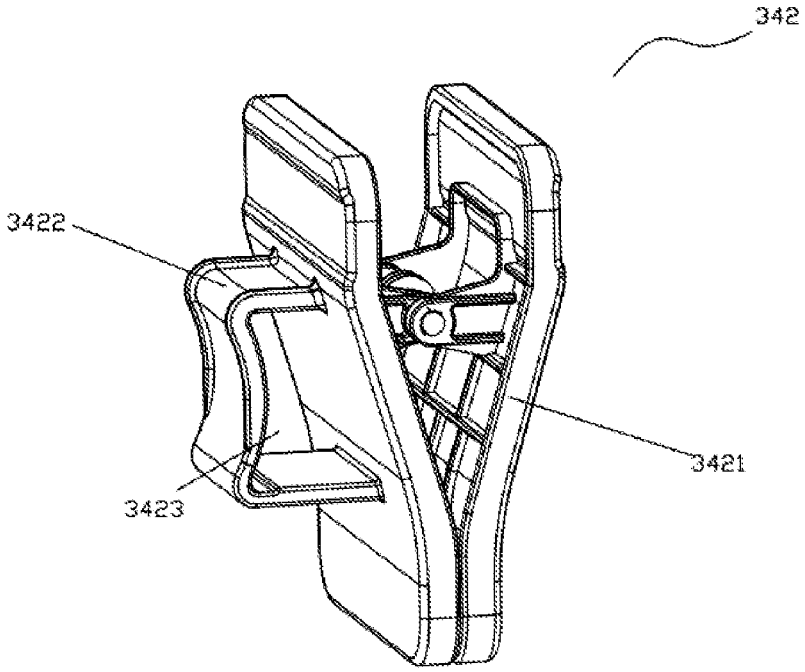
FIG. 14 is a perspective view of a clamping piece in an embodiment.

Referring to FIG. 9, the elastic adjusting unit may include a movable abutting block 26 and a cam 25. A receiving opening 222 may be formed on the lower sleeve 22, and the movable abutting block 26 may be provided in the receiving opening 222. The cam 25 may be hinged and located outside the movable abutting block 26, such that the movable abutting block 26 is located between the cam 25 and the upper sleeve 21. When it needs to be pressed, the cam 25 is rotated to make the convex portion of the cam 25 abut the movable abutting block 26, and then the movable abutting block 26 is driven to abut the upper sleeve 21, thereby compressing the upper sleeve 21 to have a further fixed effect. When it is necessary to release the pressing and tightening (i.e., when loosening), the cam 25 is rotated such that the convex portion of the cam 25 is separated from the movable abutting block 26. The operation is easy.

The lower sleeve 22 may be also sleeved with a fixing sleeve 24 on the outer periphery, and the cam 25 may be hinged on the fixing sleeve 24, such that the cam 25 can be assembled.

The process of fixing between the upper sleeve 21 and the lower sleeve 22 may be as follows. The operator holds the top seat 30 and lifts the top seat 30 up. At this time, the upper sleeve 21 and the lower sleeve 22 are stretched. When the upper sleeve 21 and the lower sleeve 22 reach the fixed position, the pin 2313 of the elastic pin 231 corresponds to the pin hole 221 of the lower sleeve 22 and pops out, such that the pin 2313 fits in the pin hole 221 for a fixing. At the same time, in order to further stabilize, the operator rotates the cam 25 again, such that the convex portion of the cam 25 abuts the movable abutting block 26, and then drives the movable abutting block 26 to abut the upper sleeve 21, thereby pressing the upper sleeve 21. When the clothing care machine needs to be stored, the cam 25 is firstly rotated, such that the convex portion of the cam 25 is separated from the movable abutting block 26, and the fixing of the elastic adjusting unit is released. Then, the button 31 on the top seat 30 is pressed down to drive the connecting rod 232 to press down, thereby releasing the fixing of the pin fixing unit 23, such that the retractable storage can be performed. The structure is simple and easy to operate.

Of course, in other embodiments, the structure of the fixing assembly is not limited to this and may be fixed by the structure of the pin fixing unit 23 alone, adopted by the other fixing components that can be fixed, etc.

The number of the support columns 20 may be two, and the two support columns 20 may be located on the left and right sides, which play a role of uniform support and improved support stability. Of course, in other embodiments, the number of the support columns 20 is not limited to this.

Embodiment 2

Referring to FIGS. 1 to 4, the present embodiment provides a clothing care machine, including a machine base 10, a support column 20, an upper part and a cloth cover 40. Specifically, the upper part may be a substantially rectangular top seat 30. The bottom of the support column 20 may be connected to the machine base 10, the top seat 30 may be connected to the top of the support column 20, and the cloth cover 40 may be provided between the machine base 10 and the top seat 30 to form an enclosed cavity. The machine base 10 may be provided with a steam outlet 11 and a hot air outlet 19 that are in communication with the enclosed cavity. When in use, the clothes are put into the enclosed cavity, and the automatic care of the clothes is realized through the cooperation of the steam output by the steam outlet 11 and the hot air output by the hot air outlet 19 of the machine base 10. Specifically, the combination of the steam output from the steam outlet 11 and the hot air output from the hot air outlet 19 may be independent outputs or alternate outputs (e.g., steam output first, then hot air output, etc.). During the process, the user does not need to operate the whole process, but only needs to put the clothes in and out, which saves time and effort.

Specifically, as shown in FIG. 3, the clothing care machine provided in the present embodiment, from a top view, may be a rectangle. The long side direction is defined as a left-right direction, and the short side direction is defined as a front-rear direction. Of course, in other embodiments, the shape of the clothing care machine is not limited to this.

Specifically, the cloth cover 40 may be provided with a zipper 401, and the cloth cover 40 is opened and closed through the zipper 401 for taking and placing clothes into the enclosed cavity.

For easy storage of clothes, referring to FIGS. 11 to 14, the bottom of the top seat 30 may be provided with a support frame 34 provided with two support rods 341 that are oppositely provided. Each of the support rods 341 may be provided with slidable clamping pieces 342. For example, when trousers need to be clamped, the clamping pieces 342 of the two support rods 341 respectively clamp the two sides of the trousers, so as to realize the smooth unfolding of the clothes. At the same time, the position adjustment of the clothes can be realized by the sliding of the clamping piece 342.

The two side surfaces of the support rod 341 may be concave surfaces. The clamping piece 342 may include a clamping body 3421 and a hanging lug 3422 extending from the clamping body 3421. The hanging lug 3422 and the clamping body 3421 are enclosed to form a through hole 3423, and the support rod 341 may be inserted into the through hole 3423 to realize the connection between the support rod 341 and the clamping piece 342. One side wall of the hanging lug 3422 may be recessed inward to mate with the concave surface of one side of the support rod 341. In this way, the mating is more stable and not easy to shake.

Specifically, both ends of the support rod 341 may be respectively connected with end covers 343 and may be detachably assembled on the top seat 30 through the end covers 343. The support rod 341 may be detachably connected with at least one of the end covers 343. In this way, when it is necessary to increase or decrease the clamping piece 342, one of the end covers 343 may be removed, and then the clamping piece 342 is inserted into or removed from the clamping piece 342, such that the operation is easy.

Of course, in other embodiments, the structure of the support frame 34 is not limited to this.

Embodiment 3

Referring to FIGS. 1 to 4, the present embodiment provides a clothing care machine, including a machine base 10, a support column 20, a cloth cover 40 and an upper part. The bottom of the support column 20 may be connected to the machine base 10. Specifically, the upper part may be a substantially rectangular top seat 30 connected to the top of the support column 20, and the cloth cover 40 may be provided between the machine base 10 and the top seat 30 to form an enclosed cavity. The machine base 10 may be provided with a steam outlet 11 and a hot air outlet 19 in communication with the enclosed cavity. When in use, the clothes are put into the enclosed cavity, and the automatic care of the clothes is realized through the cooperation of the steam output by the steam outlet 11 and the hot air output by the hot air outlet 19 of the machine base 10. Specifically, the combination of the steam output from the steam outlet 11 and the hot air output from the hot air outlet 19 may be independent outputs or alternate outputs (e.g. steam output first, then hot air output, etc.). During the process, the user does not need to operate the whole process, but only needs to put the clothes in and out, such that time and effort can be saved.

Specifically, as shown in FIG. 3, the clothing care machine provided in the present embodiment may be a similar rectangle from a top view. The long side direction is defined as a left-right direction, and the short side direction is defined as a front-rear direction. Of course, in other embodiments, the shape of the clothing care machine is not limited to this.

Specifically, the cloth cover 40 may be provided with a zipper 401, and the cloth cover 40 is opened and closed through the zipper 401 for taking and placing clothes into the enclosed cavity.

Figure 15:
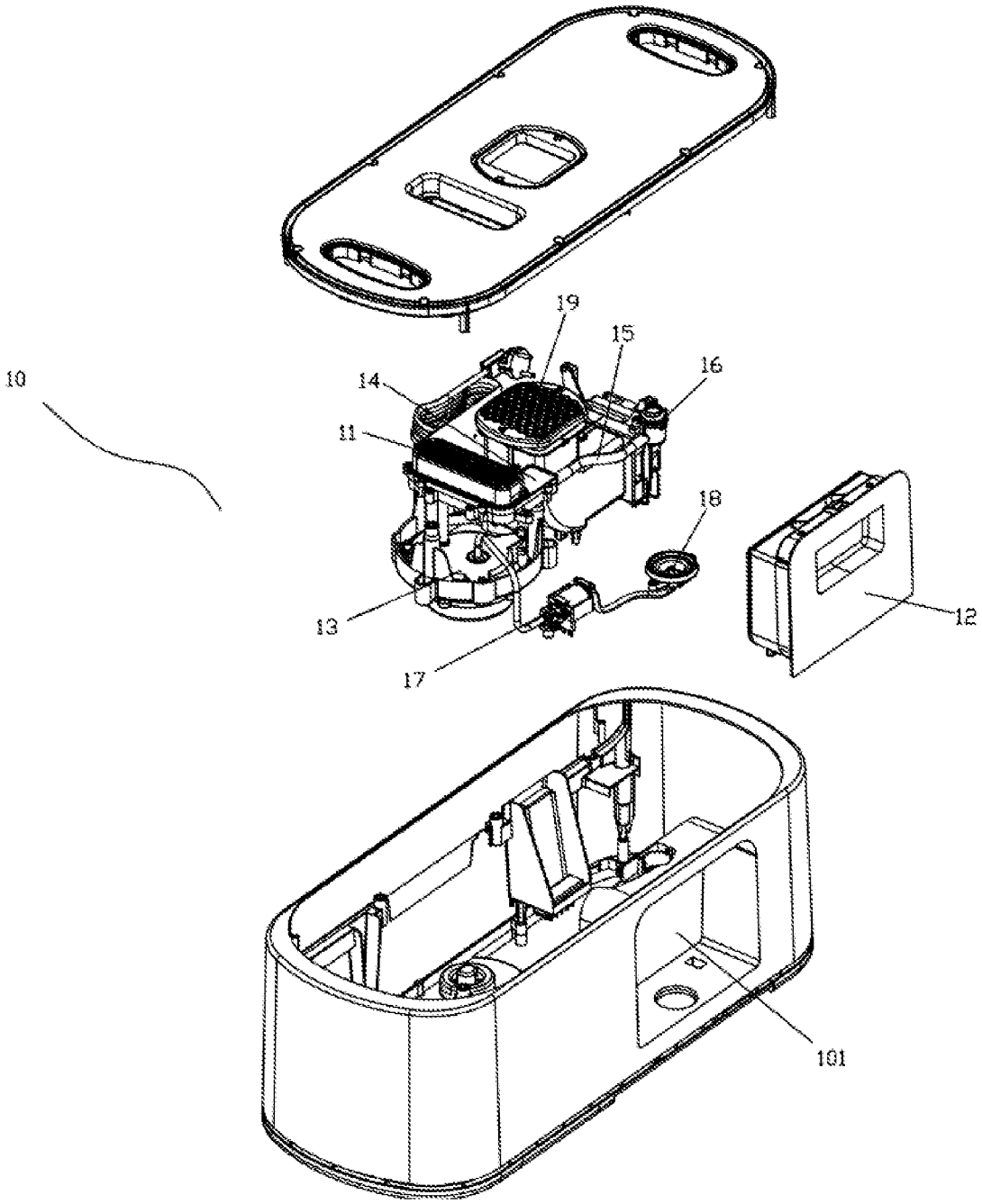
FIG. 15 is an exploded view of a structure of a machine base in an embodiment.
Figure 16:
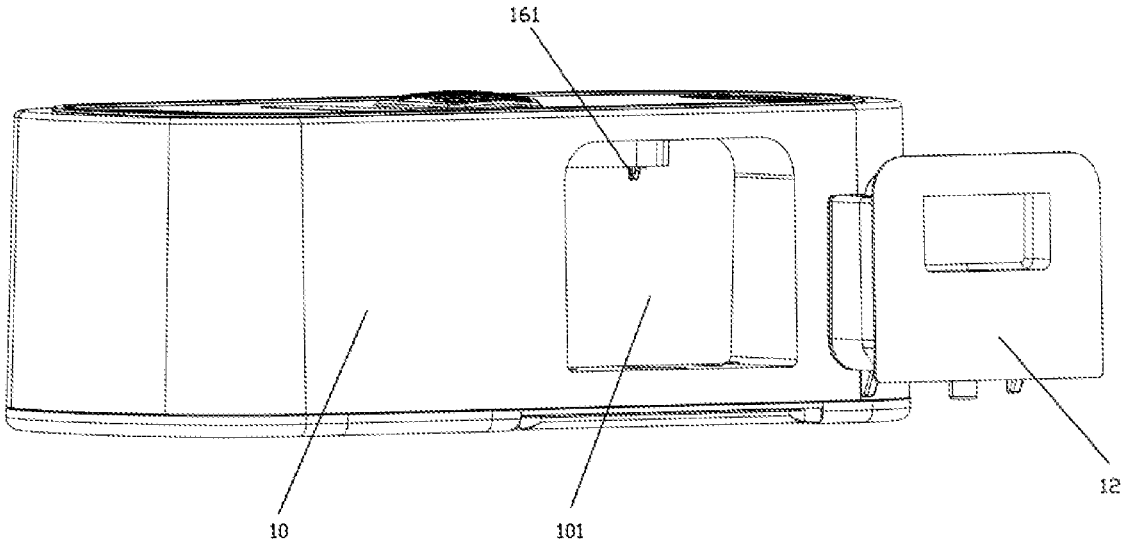
FIG. 16 is an exploded view of a partial structure of the machine base in an embodiment.
Figure 17:
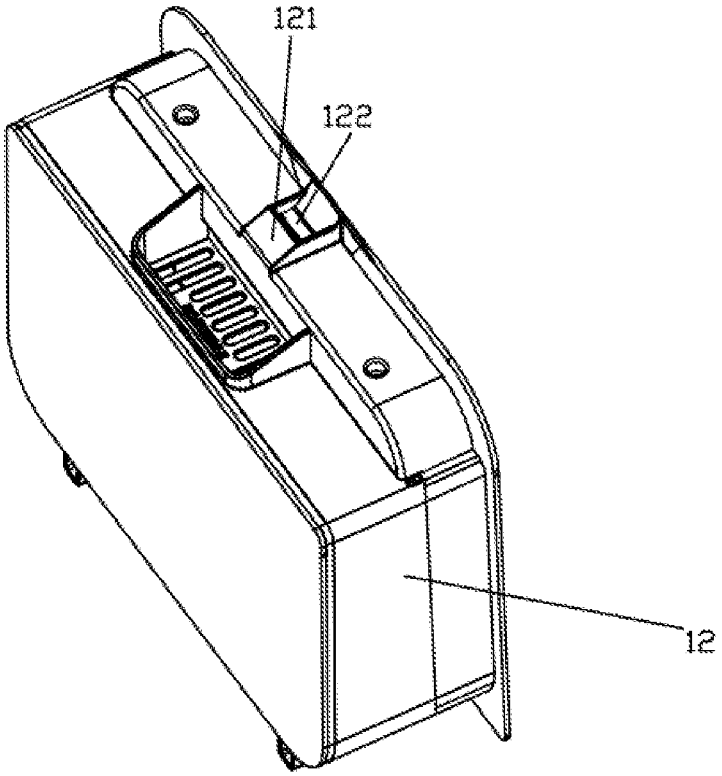
FIG. 17 is a perspective view showing a structure of the water tank in an embodiment.

Continuing to refer to FIGS. 15 to 17, the machine base 10 may be provided with a water tank 12, a heating and vaporizing boiler 13, a condensed water collector 14 and a switch valve 16. The water outlet of the water tank 12 may be in communication with the water inlet of the heating and vaporizing boiler 13 to inject water into the heating and vaporizing boiler 13, and the outlet of the heating and vaporizing boiler 13 may be in communication with to the steam outlet 11. When starting the steam operation, the heating and vaporizing boiler 13 heats the water inside to generate steam, and the steam is sprayed from the steam outlet 11 for clothing care. More specifically, a water pump 17 may be provided between the water tank 12 and the heating and vaporizing boiler 13, and the water in the water tank 12 may be pumped to the heating and vaporizing boiler 13 through the water pump 17, such that it is convenient for controlling the water volume and does not limit the positional relationship of the water tank 12 and the heating and vaporizing boiler 13.

The condensed water collector 14 may be formed on the machine base 10 for collecting condensed water. The water outlet of the condensed water collector 14 may be connected to the water inlet 122 of the water tank 12 through a recovery channel 15. The switch valve 16 may be provided in the recovery channel 15, the water tank 12 may be detachably disposed on the machine base 10, and the switch valve 16 may be triggered to open when the water tank 12 is assembled. In this way, the recovery and utilization of the condensed water can be realized. In addition, when the water tank 12 is disassembled, the switch valve 16 loses the trigger of the water tank 12 and is closed to prevent leakage of the recovered water.

Specifically, a water tank receiving cavity 101 may be recessed on the outer side of the machine base 10, and the trigger end 161 of the switch valve 16 extends into the water tank receiving cavity 101 through the top of the water tank receiving cavity 101. When the water tank 12 is assembled into the water tank receiving cavity, the trigger end 161 of the switch valve 16 is touched to trigger the switch valve 16 to open.

More specifically, in order to better trigger the switch valve 16, the upper end of the water tank 12 has an inclined abutting surface 121. When the water tank 12 is assembled into the water tank receiving cavity 101, the inclined abutting surface 121 abuts the trigger end 161 of the switch valve 16 and proceeds to trigger the switch valve 16. The inclined abutting surface 121 has a guiding function and is not easily stuck during the contact process with the trigger end 161 of the switch valve 16, such that the action is smoother. More specifically, the trigger end 161 of the switch valve 16 has an arc-shaped end surface for contacting the inclined abutting surface 121, which further reduces the contact resistance. Of course, the arrangement is not limited to this in other embodiments.

The water outlet of the water tank 12 may be a normally closed water outlet, and the bottom of the water tank receiving cavity 101 may be provided with a butt joint 18. When the water tank 12 is assembled into the water tank receiving cavity 101, the butt joint 18 may be mated with the water outlet of the water tank 12 to open the water outlet of the water tank 12, so as to realize the water flow.

Embodiment 4

Referring to FIGS. 1 to 4, the present embodiment provides a clothing care machine, including a machine base 10, a support column 20, an upper part and a cloth cover 40. Specifically, the upper part may be a substantially rectangular top seat 30. The bottom of the support column 20 may be connected to the machine base 10, the top seat 30 may be connected to the top of the support column 20, and the cloth cover 40 may be provided between the machine base 10 and the top seat 30 to form an enclosed cavity. The machine base 10 may be provided with a steam outlet 11 and a hot air outlet 19 that are in communication with the enclosed cavity. When in use, the clothes are put into the enclosed cavity, and the automatic care of the clothes is realized through the cooperation of the steam output by the steam outlet 11 and the hot air output by the hot air outlet 19 of the machine base 10. Specifically, the combination of the steam output from the steam outlet 11 and the hot air output from the hot air outlet 19 may be independent outputs or alternate outputs (e.g., steam output first, then hot air output, etc.). During the process, the user does not need to operate the whole process, but only needs to put the clothes in and out, which saves time and effort.

Specifically, as shown in FIG. 3, the clothing care machine provided in the present embodiment may be a rectangle from a top view. The long side direction is defined as the left-right direction, and the short side direction is defined as the front-rear direction. Of course, in other embodiments, the shape of the clothing care machine is not limited to this.

Figure 2:
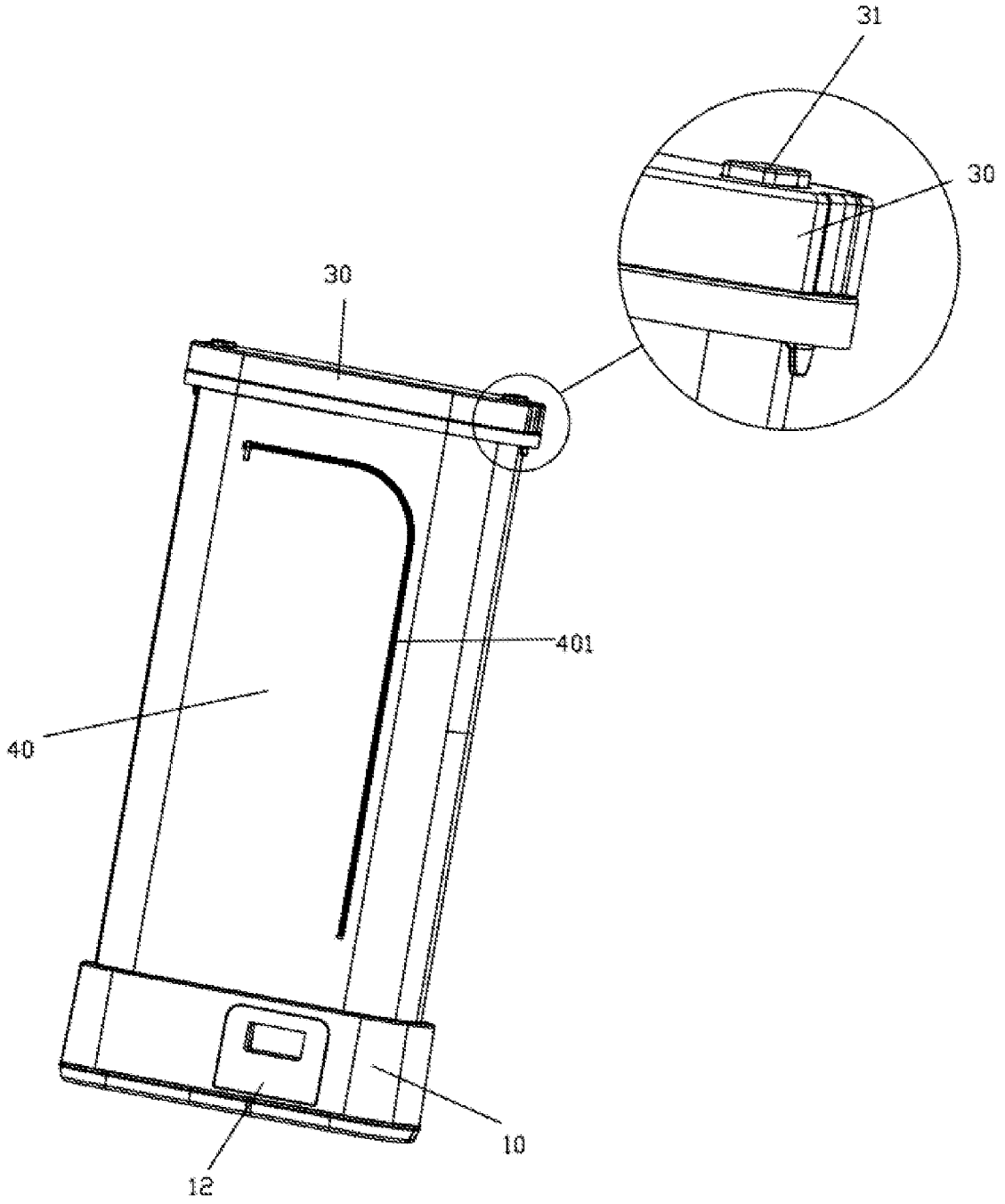
FIG. 2 is a second perspective view of the clothing care machine in an embodiment.

Further, referring to FIGS. 5 to 10, in the present embodiment, the support column 20 may be a retractable structure. In this way, through the retracting of the support column 20, the clothing care machine can be stored, and the volume after storage is small and does not occupy space. FIG. 1 and FIG. 3 are schematic diagrams of the clothing care machine in a use state, and FIG. 2 is a schematic diagram of the clothing care machine in a storage state, wherein the support column 20 is in a retracted state. Of course, in other embodiments, it can also be a fixed structure without retracting.

Specifically, the retractable structure of the support column 20 may be as follows: the support column 20 includes an upper sleeve 21 and a lower sleeve 22 that are telescopically sleeved, the lower end of the lower sleeve 22 may be connected to the machine base 10, and the upper end of the upper sleeve 21 may be connected to the top seat 30. A fixing assembly for fixing the relative positions of the upper sleeve 21 and the lower sleeve 22 may be provided between the upper sleeve 21 and the lower sleeve 22. During use, the upper sleeve 21 and the lower sleeve 22 may be fixed by the fixing assembly to obtain stable support. When the clothing care machine needs to be stored, retractable structure of the support column 20 can be retracted by releasing the fixing of the fixing assembly. At the same time, the use of the sleeve structure of the sleeve can reduce the weight very well. Of course, in other embodiments, the retractable structure of the support column 20 is not limited to this.

The fixing assembly may include a pin fixing unit 23 and a tension adjusting unit, wherein the pin fixing unit 23 may be fixed on one side, and the tension adjusting unit may be fixed on the other side.

Specifically, the pin fixing unit 23 may include: a fixing block 234, an elastic pin 231 and a connecting rod 232. The fixing block 234 may be fixed in the lower opening of the upper sleeve 21, and the elastic pin 231 may be provided on the fixing block 234. The lower sleeve 22 may be provided with a pin hole 221 corresponding to the elastic pin 231, and under the action of no external force, the pin 2313 of the elastic pin 231 protrudes and is inserted into the corresponding pin hole 221 to make the relative positions of the upper sleeve 21 and the lower sleeve 22 fixed, such that the support column 20 can be fixedly supported. The connecting rod 232 may be provided in the upper sleeve 21, and the lower end of the connecting rod 232 forms an oblique guide fit with the elastic pin 231. The upper end of the connecting rod 232 extends to the top seat 30. The connecting rod 232 can be driven to be pressed down to drive the elastic pin 231 to retract. That is, when it is necessary to release the fixation of the pin fixing unit 23, the connecting rod 232 is pressed down, and the downward movement of the connecting rod 232 drives the elastic pin 231 to retract through the inclined guide fit structure, such that the pin 2313 of the elastic pin 231 is separated from the pin hole 221, such that the fixing of the pin fixing unit 23 is released.

The lower end of the connecting rod 232 may be connected with a fitting piece 233 and forms an oblique guide fit with the elastic pin 231 through the fitting piece 233, which is convenient for connecting and fitting. The fitting piece 233 may be provided with a guide hole (not shown), and the fixing block 234 may be provided with a guide post 2341. The guide post 2341 penetrates into the guide hole to realize the guide fit, such that the fit is more precise and smoother, not easy to shift or clamp.

The elastic pin 231 may include a spring 2312 and a pin body 2311, and a blind hole 2342 may be formed on the fixing block 234. The spring 2312 and the pin body 2311 may be inserted into the blind hole 2342, and the spring 2312 applies an outward elastic force to the pin body 2311. The outer end of the pin body 2311 protrudes with the pin 2313 mated with the pin hole 221. The structure is simple and easy to implement. More specifically, the fitting piece 233 forms an oblique guide fit with the pin body 2311.

The top seat 30 may be provided with a button 31, and the upper end of the connecting rod 232 abuts the button 31. By pressing the button 31, the connecting rod 232 is driven to be pressed down, which is convenient for operation. More specifically, the button 31 may be a rocker button, one end of the button 31 is provided with a hinge. The upper end of the connecting rod 232 may be in contact with the middle position of the button 31, and the other end of the button 31 may be lifted up as a pressing end. By means of rocker buttons, the operation is more convenient and labor-saving, and the structure is simple and easy to implement.

Referring to FIG. 9, the elastic adjusting unit may include a movable abutting block 26 and a cam 25. A receiving opening 222 may be formed on the lower sleeve 22, and the movable abutting block 26 may be provided in the receiving opening 222. The cam 25 may be hinged and located outside the movable abutting block 26, such that the movable abutting block 26 is located between the cam 25 and the upper sleeve 21. When it needs to be pressed, the cam 25 is rotated to make the convex portion of the cam 25 abut the movable abutting block 26, and then the movable abutting block 26 is driven to abut the upper sleeve 21, thereby compressing the upper sleeve 21 to have a further fixed effect. When it is necessary to release the pressing and tightening (i.e., when loosening), the cam 25 is rotated such that the convex portion of the cam 25 is separated from the movable abutting block 26. The operation is easy.

The lower sleeve 22 may be also sleeved with a fixing sleeve 24 on the outer periphery, and the cam 25 may be hinged on the fixing sleeve 24, such that the cam 25 can be assembled.

The process of fixing between the upper sleeve 21 and the lower sleeve 22 may be as follows. The operator holds the top seat 30 and lifts the top seat 30 up. At this time, the upper sleeve 21 and the lower sleeve 22 are stretched. When the upper sleeve 21 and the lower sleeve 22 reach the fixed position, the pin 2313 of the elastic pin 231 corresponds to the pin hole 221 of the lower sleeve 22 and pops out, such that the pin 2313 fits in the pin hole 221 for a fixing. At the same time, in order to further stabilize, the operator rotates the cam 25 again, such that the convex portion of the cam 25 abuts the movable abutting block 26, and then drives the movable abutting block 26 to abut the upper sleeve 21, thereby pressing the upper sleeve 21. When the clothing care machine needs to be stored, the cam 25 is firstly rotated, such that the convex portion of the cam 25 is separated from the movable abutting block 26, and the fixing of the elastic adjusting unit is released. Then, the button 31 on the top seat 30 is pressed down to drive the connecting rod 232 to press down, thereby releasing the fixing of the pin fixing unit 23, such that the retractable storage can be performed. The structure is simple and easy to operate.

Of course, in other embodiments, the structure of the fixing assembly is not limited to this and may be fixed by the structure of the pin fixing unit 23 alone, adopted by the other fixing components that can be fixed, etc.

The number of the support columns 20 may be two, and the two support columns 20 may be located on the left and right sides, which play a role of uniform support and have better support stability. Of course, in other embodiments, the number of the support columns 20 is not limited to this.

Specifically, the cloth cover 40 may be provided with a zipper 401, and the cloth cover 40 which may be opened and closed through the zipper 401 for taking and placing clothes into the enclosed cavity.

For easy storage of clothes, referring to FIGS. 11 to 14, the bottom of the top seat 30 may be provided with a support frame 34 provided with two support rods 341 that are oppositely provided. Each of the support rods 341 may be provided with slidable clamping pieces 342. For example, when trousers need to be clamped, the clamping pieces 342 of the two support rods 341 respectively clamp the two sides of the trousers, so as to realize the smooth unfolding of the clothes. At the same time, the position adjustment of the clothes can be realized by the sliding of the clamping piece 342.

The two side surfaces of the support rod 341 may be concave surfaces. The clamping piece 342 may include a clamping body 3421 and a hanging lug 3422 extending from the clamping body 3421. The hanging lug 3422 and the clamping body 3421 are enclosed to form a through hole 3423, and the support rod 341 may be inserted into the through hole 3423 to realize the connection between the support rod 341 and the clamping piece 342. One side wall of the hanging lug 3422 may be recessed inward to mate with the concave surface of one side of the support rod 341. In this way, the mating is more stable and not easy to shake.

Specifically, both ends of the support rod 341 may be respectively connected with end covers 343 and may be detachably assembled on the top seat 30 through the end covers 343. The support rod 341 may be detachably connected with at least one of the end covers 343. In this way, when it is necessary to increase or decrease the clamping piece 342, one of the end covers 343 may be removed, and then the clamping piece 342 is inserted into or removed from the clamping piece 342, such that the operation is easy.

Of course, in other embodiments, the structure of the support frame 34 is not limited to this.

Continuing to refer to FIGS. 15 to 17, the machine base 10 may be provided with a water tank 12, a heating and vaporizing boiler 13, a condensed water collector 14 and a switch valve 16. The water outlet of the water tank 12 may be in communication with the water inlet of the heating and vaporizing boiler 13 to inject water into the heating and vaporizing boiler 13, and the outlet of the heating and vaporizing boiler 13 may be communicated to the steam outlet 11. When starting the steam operation, the heating and vaporizing boiler 13 heats the water inside to generate steam, and the steam is sprayed from the steam outlet 11 for clothing care. More specifically, a water pump 17 may be provided between the water tank 12 and the heating and vaporizing boiler 13, and the water in the water tank 12 may be pumped to the heating and vaporizing boiler 13 through the water pump 17, such that it is convenient for controlling the water volume and does not limit the positional relationship of the water tank 12 and the heating and vaporizing boiler 13.

The condensed water collector 14 may be formed on the machine base 10 for collecting condensed water. The water outlet of the condensed water collector 14 may be connected to the water inlet 122 of the water tank 12 through a recovery channel 15. The switch valve 16 may be provided in the recovery channel 15, the water tank 12 may be detachably disposed on the machine base 10, and the switch valve 16 may be triggered to open when the water tank 12 is assembled. In this way, the recovery and utilization of the condensed water can be realized. In addition, when the water tank 12 is disassembled, the switch valve 16 loses the trigger of the water tank 12 and is closed to prevent the leakage of the recovered water.

Specifically, a water tank receiving cavity 101 may be recessed on the outer side of the machine base 10, and the trigger end 161 of the switch valve 16 extends into the water tank receiving cavity 101 through the top of the water tank receiving cavity 101. When the water tank 12 is assembled into the water tank receiving cavity, the trigger end 161 of the switch valve 16 is touched to trigger the switch valve 16 to open.

More specifically, in order to better trigger the switch valve 16, the upper end of the water tank 12 has an inclined abutting surface 121. When the water tank 12 is assembled into the water tank receiving cavity 101, the inclined abutting surface 121 abuts the trigger end 161 of the switch valve 16 and proceeds to trigger the switch valve 16. The inclined abutting surface 121 has a guiding function and is not easily stuck during the contact process with the trigger end 161 of the switch valve 16, such that the action is smoother. More specifically, the trigger end 161 of the switch valve 16 has an arc-shaped end surface for contacting the inclined abutting surface 121, which further reduces the contact resistance. Of course, the arrangement is not limited to this in other embodiments.

The water outlet of the water tank 12 may be a normally closed water outlet, and the bottom of the water tank receiving cavity 101 may be provided with a butt joint 18. When the water tank 12 is assembled into the water tank receiving cavity 101, the butt joint 18 may be mated with the water outlet of the water tank 12 to open the water outlet of the water tank 12, so as to realize the water flow.

Embodiment 5

A clothing care machine provided in the present embodiment has a substantially same structure as Embodiment 1 or Embodiment 2 or Embodiment 3 or Embodiment 4. The difference is that in the present embodiment, the upper part is directly a clothes hanger structure without a cloth cover structure. At the same time, the machine base is only provided with a steam outlet.

Embodiment 6

The structure of a clothing care machine provided in the present embodiment is substantially the same as that of the Embodiment 1, except that in the present embodiment, the machine base is only provided with a hot air outlet.

Although the present disclosure has been particularly shown and described in connection with preferred embodiments, it will be understood by those skilled in the art that various changes in form and detail made to the present disclosure without departing from the spirit and scope of the present disclosure as defined by the appended claims all fall within the protection scope of the present disclosure.

What is claimed is:

1. A clothing care machine, comprising a machine base, a support column, a cloth cover and a top seat, wherein the cloth cover is provided between the machine base and the top seat to form an enclosed cavity, the cloth cover is provided with a zipper, and the cloth cover is configured to be opened and closed through the zipper, for taking clothes out from and placing clothes into the enclosed cavity;

wherein the support column comprises an upper sleeve and a lower sleeve that are telescopically sleeved, a lower end of the lower sleeve is connected to the machine base, an upper end of the upper sleeve is connected to the top seat, and a fixing assembly comprising a fixing block, an elastic pin, a connecting rod, a movable abutting block and a cam, configured for fixing relative positions of the upper sleeve and the lower sleeve is provided between the upper sleeve and the lower sleeve, such that through retracting of the support column, the clothing care machine is stored and has a reduced volume after storage;

wherein the machine base is provided with at least one of a steam outlet or a hot air outlet;

wherein the machine base is provided with a water tank, a heating and vaporizing boiler, a condensed water collector and a switch valve, a water outlet of the water tank is connected to a water inlet of the heating and vaporizing boiler, an outlet of the heating and vaporizing boiler is connected to the steam outlet, the condensed water collector is disposed on the machine base for collecting condensed water, a water outlet of the condensed water collector is in communication with a water inlet of the water tank through a recovery channel, the switch valve is provided in the recovery channel, the water tank is detachably provided on the machine base;

wherein an upper end of the water tank has an inclined abutting surface, an outside of the machine base is recessed with a water tank receiving cavity, a trigger end of the switch valve extends into the water tank receiving cavity through a top of the water tank receiving cavity, and when the water tank is assembled into the water tank receiving cavity, the inclined abutting surface abuts the trigger end of the switch valve and the switch valve is triggered to be activated; and wherein a water pump is provided between the water tank and the heating and vaporizing boiler, and water in the water tank is pumped into the heating and vaporizing boiler through the water pump; when the water tank is disassembled, the switch valve is closed to prevent leakage of recovered water.

2. The clothing care machine according to claim 1, wherein the fixing block is fixed in a lower opening of the upper sleeve, the elastic pin is provided on the fixing block, the lower sleeve is provided with a pin hole corresponding to the elastic pin, under an action of no external force, a pin of the elastic pin protrudes and is inserted into the pin hole, such that the relative positions of the upper sleeve and the lower sleeve are fixed, the connecting rod is provided in the upper sleeve, a lower end of the connecting rod forms an oblique guide fit with the elastic pin, an upper end of the connecting rod extends to the top seat, and the elastic pin is driven to retract by the upper end of the connecting rod by driving the connecting rod to press down.

3. The clothing care machine according to claim 2, wherein the lower end of the connecting rod is connected with a fitting piece provided with a guide hole, the fixing block is provided with a guide post penetrating into the guide hole, and the fixing block forms an oblique guide fit with the elastic pin through the fitting piece.

4. The clothing care machine according to claim 3, wherein the elastic pin comprises a spring and a pin body, the fixing block is provided with a blind hole, the spring and the pin body are inserted in the blind hole, and when the spring exerts an outward elastic force on the pin body, an outer end of the pin body is protruded with the pin mated with the pin hole.

5. The clothing care machine according to claim 2, wherein the top seat is provided with a button, the upper end of the connecting rod abuts the button, and the connecting rod is pressed down by pressing the button.

6. The clothing care machine according to claim 2, wherein the lower sleeve is provided with a receiving opening, the movable abutting block is provided in the receiving opening, and the cam is provided with a hinge and located outside the movable abutting block, such that the movable abutting block is located between the cam and the upper sleeve.

7. The clothing care machine according to claim 1, wherein the water outlet of the water tank is a normally closed water outlet, the water tank receiving cavity is provided with a butt joint at a bottom of the water tank receiving cavity, and when the water tank is assembled into the water tank receiving cavity, the butt joint cooperates with the water outlet of the water tank to open the water outlet of the water tank.

8. The clothing care machine according to claim 1, wherein the top seat is provided with a support frame provided with a support rod, and the support rod is provided with a clamping piece.

9. The clothing care machine according to claim 8, wherein two side surfaces of the support rod are concave surfaces, the clamping piece comprises a clamping body and a hanging lug extending from the clamping body, the hanging lug and the clamping body are enclosed to form a through hole, the support rod penetrates into the through hole to have a connection between the support rod and the clamping piece, and one side wall of the hanging lug is inwardly recessed and mated with one side concave surface of the support rod.

10. The clothing care machine according to claim 9, wherein two ends of the support rod are respectively connected with end covers and are detachably assembled on the top seat through the end covers, and the support rod is detachably connected to at least one of the end covers.

* * * * *